United States Patent [19]

Wheeler

[11] 4,216,846

[45] Aug. 12, 1980

[54] ELEVATOR RAIL CLEANING SYSTEM

[75] Inventor: John H. Wheeler, Dallas, Tex.

[73] Assignee: The Texacone Company, Dallas, Tex.

[21] Appl. No.: 858,640

[22] Filed: Dec. 8, 1977

Related U.S. Application Data

[63] Continuation-in-part of Ser. No. 721,984, Sep. 10, 1976, Pat. No. 4,089,137.

[51] Int. Cl.[2] ..... B66B 7/12

[52] U.S. Cl. ..... 187/1 R; 104/279; 187/95

[58] Field of Search ..... 187/1 R, 95; 308/3 B; 104/279; 15/54, 93 R; 51/295, 299, 309

[56] References Cited

U.S. PATENT DOCUMENTS

| | | | |
|---|---|---|---|
| 1,907,966 | 5/1933 | Henry | 308/3 B |
| 1,924,974 | 8/1933 | Blustein | 51/299 X |
| 2,042,029 | 5/1936 | Smith | 104/279 |
| 2,045,620 | 6/1936 | Spullies | 187/95 X |
| 2,222,191 | 11/1940 | Zisman | 15/104.04 X |
| 2,435,742 | 2/1948 | Gaither | 308/3 B |
| 2,475,771 | 7/1949 | Wittner | 104/279 |
| 2,490,652 | 12/1949 | Sahlin | 308/3 B |
| 2,601,503 | 6/1952 | Cornish | 187/95 |
| 2,667,929 | 2/1954 | Hunt | 175/84 |
| 2,743,966 | 5/1956 | McKernan | 308/3 B |
| 3,004,273 | 10/1961 | Rushmer | 104/279 X |
| 3,103,897 | 9/1963 | Bonanno et al. | 104/279 |
| 3,177,056 | 4/1965 | Höfelmann et al. | 51/295 X |
| 3,382,058 | 5/1968 | Wise et al. | 51/295 X |
| 3,905,452 | 9/1975 | Schirmer | 187/1 R |
| 4,062,295 | 12/1977 | Hamann | 104/279 |

*Primary Examiner*—James L. Rowland

*Attorney, Agent, or Firm*—Richards, Harris & Medlock

[57] ABSTRACT

An apparatus is provided for continuously cleaning rust and other corrosion from elevator guide rails and for filling pits, joints and other irregular areas in the rails. A plurality of guide brackets are mounted on the car for contact with the rail. Each guide bracket includes a bushing insert for contact with surfaces of the guide rail. In one embodiment, the insert is made from an elastomeric material with particles of bronze or brass embedded therein. In a second embodiment, the insert has lead embedded therein. Where the insert has bronze or brass embedded therein, the sliding of the insert relative to the walls of the guide rails acts as an abrasive cleaner to remove rust, corrosion and dirt particles from the surface of the rails. Where the insert has lead embedded therein, contact between the insert and the rail results in the transfer of lead to the rails to fill pits, joint areas and irregularities in the rails. The inserts are formed with a plurality of ribs in which some are inclined upwardly while others are inclined downwardly from the longitudinal axis of the rail. Corrosion and rust scoured from the rail are channeled by the ribs and intermediate troughs away from the operating surface of the rails. Brush units are attached to the elevator car on opposite sides of each rail for contact with the rails. A cleaning solution is supplied to the brush units to provide further cleaning of the rails during operation of the elevator.

16 Claims, 10 Drawing Figures

ELEVATOR RAIL CLEANING SYSTEM

This application is a continuation in part of application Ser. No. 721,984, filed Sept. 10, 1976, now U.S. Pat. No. 4,089,137.

BACKGROUND OF THE INVENTION

1. Field of the Invention

The present invention relates to a system for cleaning and filling irregularities in the rails in an elevator system, and more particularly to a system for automatically and continuously performing such maintenance as the elevator is operated.

2. Prior Art

Modern elevators operate by translating along stationary guide rails positioned in the hoistway of a building. The elevator car is guided by the guide rails by the use of rollers or slides which engage the guide rails as the car moves from floor to floor. The smooth operation of the elevator car is largely dependent upon the interaction between the guide rails and the rollers or slides which track the rails. Therefore, it is particularly important that the rail surface tracked by the elevator car be free from rust, corrosion or dirt. It is also imperative that pits and surface irregularites formed by rust and track usage be remedied to assure safe and smooth operation of the elevator car. Likewise, the joints between mating guide rails must be continuously filled in order to provide a smooth transition between adjoining rails.

Cleaning of the guide rails has normally been accomplished by the attachment of a cleaning mechanism to the elevator car adjacent the guide rail. These cleaning mechanisms have generally consisted of scrapers, either solid or wire, which are biased against the rails. Because of the pressure required to completely clean the guide rails, these cleaning apparatus have often damaged the rails. To avoid such damage, some cleaning of the rails is still performed manually. Personnel ride the top of the elevator car and manually clean the guide rails as the car is translated from floor to floor. Obviously, this is a very dangerous as well as difficult and time consuming operation. Moreover, such cleaning can only be performed periodically and thus between operations the rails are left unmaintained.

Pits formed in the rails as a result of usage and corrosion, are also normally filled manually. In other cases, the pits are left unfilled until the rails have become so pitted that they must be replaced. Likewise, joints between the rails are normally filled manually by applying solder or by welding. Where these functions are done manually, they are generally performed periodically without any special attention to damage to the rails which may occur during normal operation of the elevator system. Thus, unless there is a continuous inspection of the rails, a damaged area or heavily pitted area will be left unattended until the periodic maintenance of the rails is made.

SUMMARY OF THE INVENTION

The present invention provides an apparatus for continuously cleaning rust and other corrosion from elevator guide rails and for filling pits, joints and other irregular areas in the rails. The present invention is used in an elevator system having an elevator car mounted for movement along an elevator rail. A plurality of guide brackets are mounted on the car for contact with the rail. Each guide bracket includes a receiving bracket and a bushing insert fitted within the receiving bracket for contact with surfaces of the guide rail. The bushing insert is made from an elastomeric material with particles of bronze or brass embedded therein. The insert contacts the elevator guide rail such that the slide surfaces of the elevator rail are contacted by the walls of the insert. Where the insert has bronze or brass embedded therein, the sliding of the insert relative to the walls of the guide rail acts as an abrasive cleaner to remove rust, corrosion and dirt particles from the surface of the guide rail. The elastomeric matrix in which the bronze or brass is embedded acts as a resilient cushion between the rail and the elevator car thereby preventing damage to the rails.

The insert is sized to assure surface contact with the guide rails but with sufficient clearance to prevent binding as the inserts move relative to the rails. The insert is formed with a plurality of ribs having troughs therebetween. A plurality of these ribs are inclined upwardly relative to the longitudinal axis of the rail while others are inclined downwardly from the longitudinal axis of the rail. In this embodiment, corrosion and rust scoured from the rail are channeled by the ribs and intermediate trough areas away from the operating surface of the rails.

In another embodiment of the invention, brush units are attached to the elevator car on opposite sides of each rail for contact with the rails. A cleaning solution is supplied to the brush units to provide further cleaning of the rails during operation of the elevator.

In still another embodiment of the invention, the elastomeric guide insert is formed with lead embedded therein. In this embodiment, the lead embedded in the elastomeric matrix of the insert is brought into contact with the surface of the guide rail during operation of the elevator car. As a result, lead is transferred from the insert to the guide rails to fill pits and other irregularities in the guide rails. Moreover, lead is transferred from the insert into the joint areas between adjacent guide rails thereby continuously maintaining a filled joint area at all times.

The elastomeric matrix provided in the bushing insert assures continuous contact of the bushing with the guide rail while providing a resilient cushion between the contacting surfaces. The bushings are also formed with elevated ribs and troughs therebetween to permit additional pressure contact between the bushings and the guide rails. Further, the ribs are inclined relative to the longitudal axis of the guide rails and act as a channel to divert debris and other foreign matter on the rails away from the operating surfaces.

BRIEF DESCRIPTION OF THE DRAWINGS

The invention may be better understood, and further advantages and uses thereof more readily apparent, when considered in view of the following detailed description of the accompanying drawings, in which.

DESCRIPTION OF THE PREFERRED EMBODIMENTS

Figure 1:
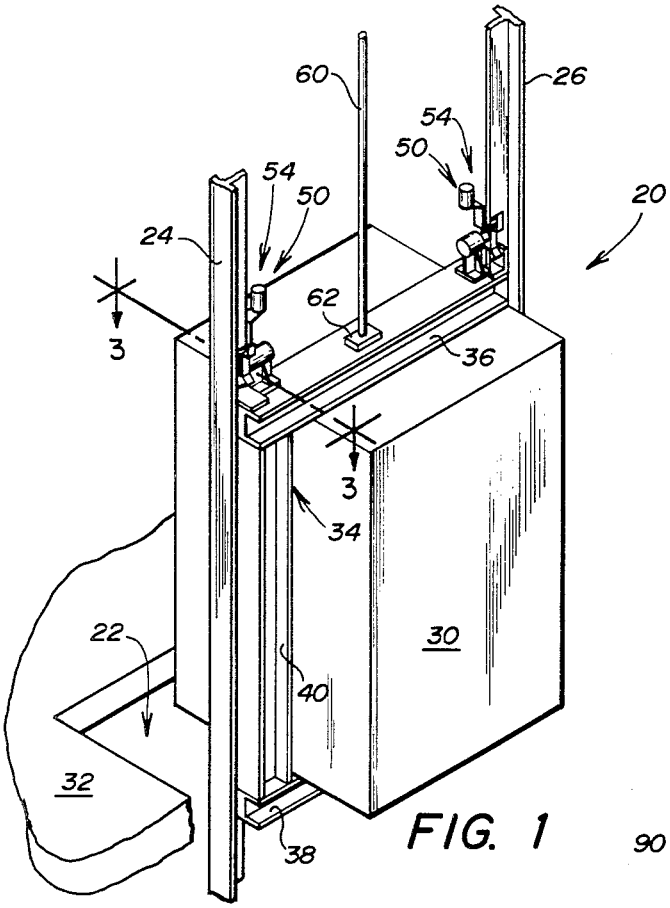
FIG. 1 is a perspective view of an elevator system embodying the present invention.
Figure 3:
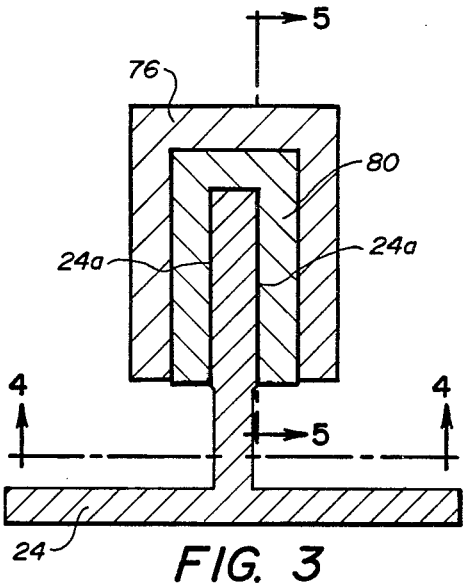
FIG. 3 is a top plan view of the elevator rail and guide assembly as seen from along lines 3—3 of FIG. 1.

Referring now to the drawings, and in particular FIG. 1, there is shown an elevator system 20 embodying the present invention. Elevator system 20 includes a guide system mounted in an elevator hoistway 22. The guide system consists of a pair of spaced parallel guide rails 24 and 26 supported along hoistway 22 at appropriate intervals. An elevator car 30 is mounted for movement relative to guide rails 24 and 26 and within hoistway 22 to provide service between various floors 32 in a multistory building. Car 30 is surrounded by frame structure 32 including upper and lower crosshead channel members 36 and 38, respectively, and side stiles 40. These frame members are rigidly attached to car 30 and provide rigidity to the car structure as well as a means for supporting the car between guide rails 24 and 26.

A guide assembly 50 is attached to upper crosshead channel member 36 adjacent guide rail 24. Similarly, an identical guide assembly 50 is attached to the opposite end of upper crosshead channel member 36 adjacent guide rail 26. Cleaning assemblies 54 are mounted adjacent to each guide assembly 50 and engage rails 24 and 26.

Guide assemblies 50 engage the guide rails 24 and 26, as will be hereinafter discussed in greater detail, to guide and stabilize the elevator car as it moves along the guide rails. A cable 60 is attached at the midpoint of upper crosshead channel member 36 by an appropriate fitting 62. Cable 60 is drawn in and let out by a suitable draw motor (not shown) to translate elevator car 30 upwardly and downwardly within hoistway 22.

Figure 2:
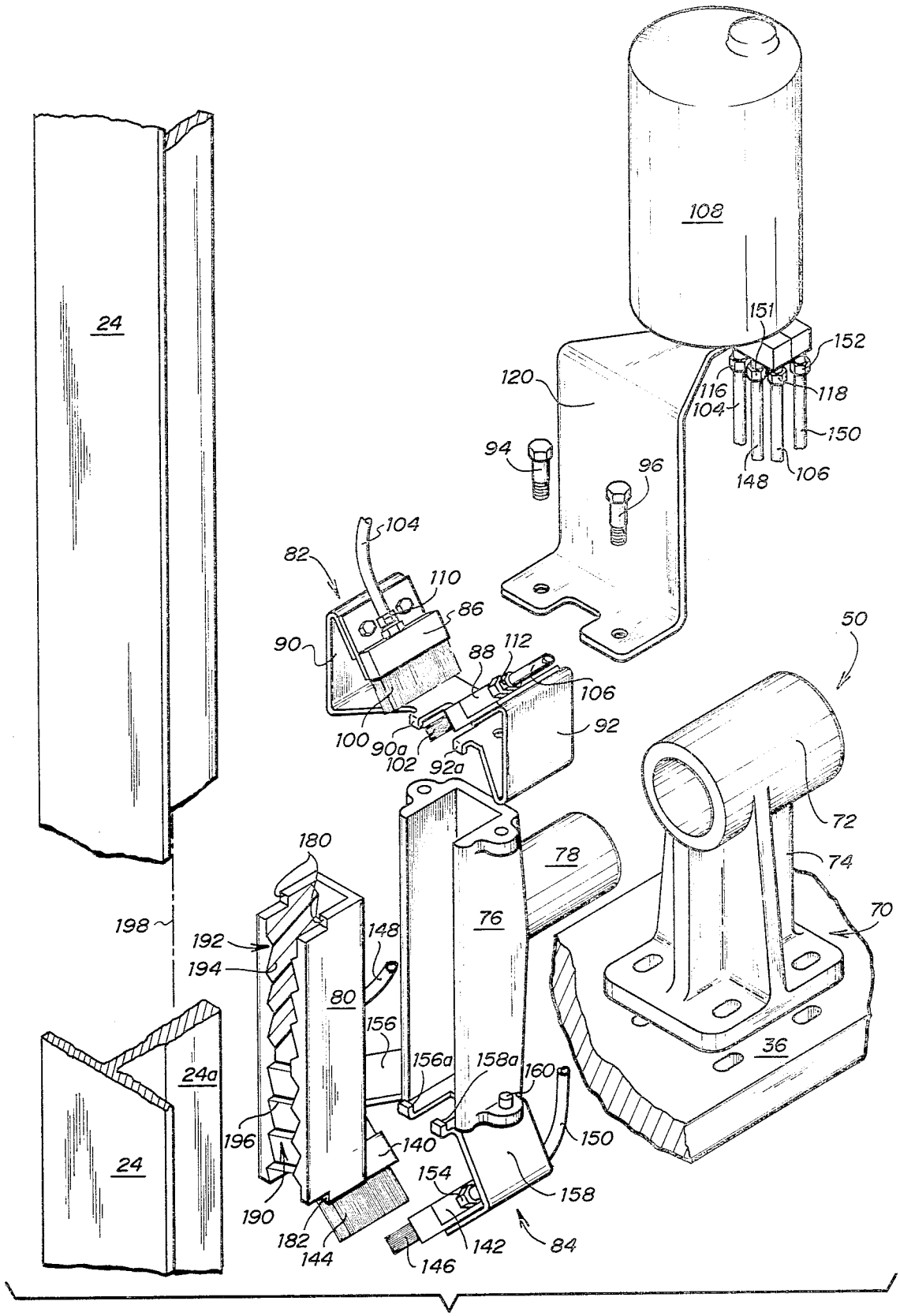
FIG. 2 is an enlarged exploded perspective view of the elevator guide system of the embodiment of FIG. 1.
Figure 6:
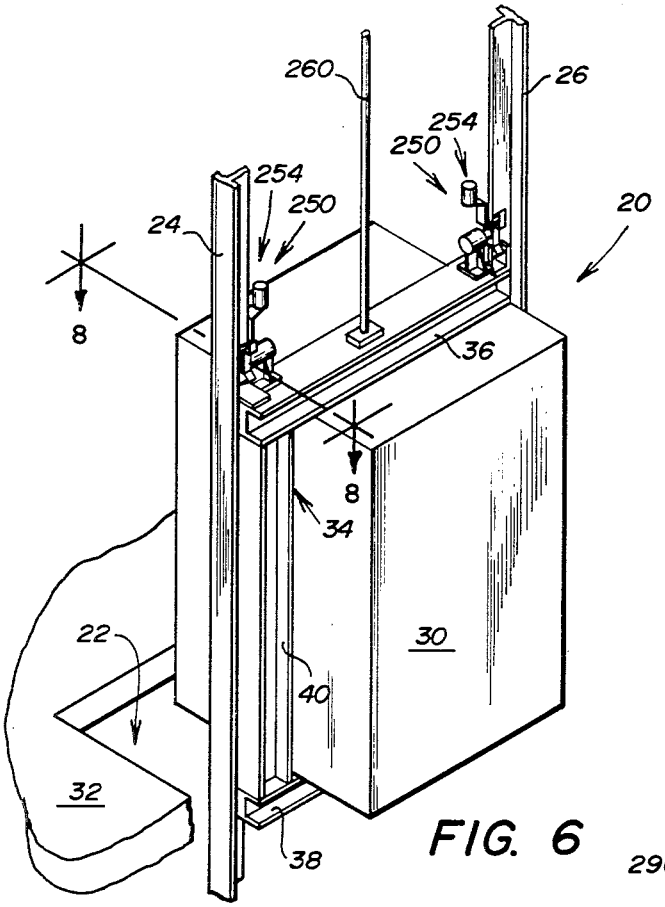
FIG. 6 is a perspective view of another embodiment of an elevator system of the present invention.
Figure 8:
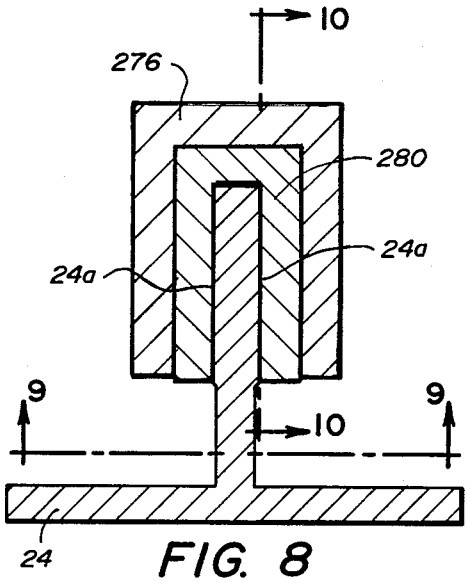
FIG. 8 is a top plan view of the elevator rail and guide assembly as seen from along line 8—8 of FIG. 6.

One of the guide assemblies 50 and cleaning assemblies 54 is shown in greater detail in FIGS. 2–5. Referring to FIG. 2, guide assembly 50 includes a bracket 70 having a sleeve portion 72 supported from a base 74 which is attached to upper crosshead channel member 36. A channel bracket 76 is formed with a trunnion 78 which is received in sleeve 72 of bracket 70. A channel insert 80 formed in a U-shaped configuration is received within the mouth of channel bracket 76.

Cleaning assembly 54 includes an upper unit 82 and a lower unit 84. Upper unit 82 includes a pair of brush assemblies 86 and 88 supported from channel bracket 76 by brackets 90 and 92, respectively. Brackets 90 and 92 are attached to channel bracket 76 by any suitable means such as bolts 94 and 96, respectively. When attached to the upper end of channel bracket 76, brackets 90 and 92 partially close the upper end of bracket 76. Brackets 90 and 92 are also formed with turned down lips 90*a* and 92*a*, respectively.

Brush assemblies 86 and 88 include brushes 100 and 102, respectively, which are fed liquid through lines 104 and 106, respectively, from a fluid reservoir 108. Fluid reservoir 108 is supported from channel bracket 76 and above brush brackets 90 and 92 by bracket 120. Bolts 94 and 96 are used for the attachment of bracket 120 to channel bracket 76 as is illustrated in FIG. 2. The connection of lines 104 and 106 to brush assemblies 86 and 88 are by way of appropriate couplings 110 and 112. Similarly, lines 104 and 106 are attached to reservoir 108 by couplings 116 and 118, respectively.

Figure 4:
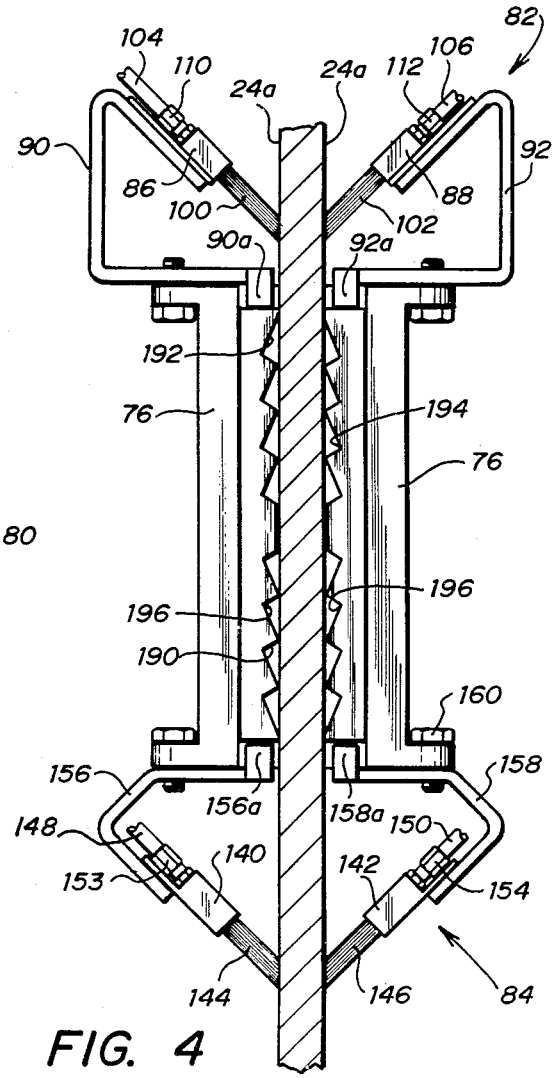
FIG. 4 is a section view taken along line 4—4 of FIG. 3.

Lower cleaning assembly 84 is similar in construction to upper cleaning assembly 82. Specifically, lower cleaning assembly 84 includes brush assemblies 140 and 142 which support brushes 144 and 146 therefrom. Brushes 144 and 146 are fed from reservoir 108 by way of lines 148 and 150, respectively. Lines 148 and 150 are attached at one end to reservoir 108 by couplings 151 and 152, respectively, and at the opposite end to assemblies 140 and 142, respectively, by couplings 153 and 154 (FIG. 4). Brush assemblies 140 and 142 are supported from channel bracket 76 by brackets 156 and 158. Brackets 156 and 158 are attached to channel bracket 76 by suitable means such as fasteners 160 and when attached to channel bracket 76 partially close the lower end of channel bracket 76. Brackets 156 and 158 are formed with upturned lips 156*a* and 158*a*, respectively.

Insert 80 is formed as a U-shaped channel with its outer dimensions sized so that it is receivable within channel bracket 76. The upper and lower ends of insert 80 are formed with steps 180 and 182, respectively. When assembled, steps 180 and 182 are engaged by lips 90*a*, 92*a* and 156*a*, 158*a*, respectively, which retain insert 80 in a seated position within channel bracket 76.

Figure 5:
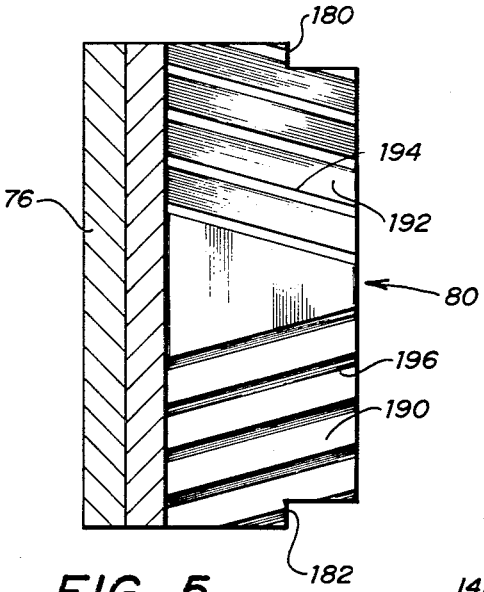
FIG. 5 is a section view taken along line 5—5 of FIG. 3.

Referring to FIGS. 2, 4 and 5, the inner side walls of insert 80 are formed with a plurality of ribs 190 and 192 with troughs 194 and 196 formed therebetween. As is best seen in FIG. 5, ribs 192 are inclined upwardly from the open mouth of insert 80 while ribs 190 are inclined downwardly from the mouth of insert 80. Both ribs 190 and 192 are inclined relative to the longitudinal axis identified by numeral 198 of rail 24 and toward the side surfaces 24*a* thereof (FIG. 2).

The composition of insert 80 is important to the present invention. In one embodiment of the invention, insert 80 is constructed from an elastomeric material having bronze or brass embedded therein. The elastomeric material forms a matrix with the bronze or brass being embedded throughout the insert. Insert 80 is designed to be in contact with surfaces 24*a* of rail 24. In one embodiment, insert 80 is formed with an interference contact with surfaces 24*a* of rail 24 while in another embodiment, a slight clearance is provided between the ribs 190 and 192 on the inner side surface of insert 80 and surfaces 24*a* of rail 24. In this embodiment, clearance is provided to prevent binding between insert 80 and rail 24. However, periodic contact is assured between the insert and rail 24 as the elevator car moves relative to the rail.

Use of an insert formed from an elastomeric material with bronze or brass embedded therein has been found to be extremely successful in removing rust and corrosion from the elevator rails. This composition of material has been found to successfully scour the elevator rails as the insert moves therealong. The elastomeric material provides resilience at the point of contact between the elevator rail and the guide assembly while assuring the continuous contact of bronze or brass against the rail surfaces. It will also be appreciated that the system of the present invention provides for continuous as opposed to only periodic scouring of the rails as a result of the continuous contact between insert 80 and rail 24.

The inclined ribs 190 and 192 and the intermediate troughs therebetween act to remove the rust and corrosion cleaned from the rails. Thus, as the guide assembly moves along the elevator rails, corrosion and rust cleaned from the rail surfaces are channeled by way of troughs 194 and 196 between ribs 190 and 192 away from the main contact area between insert 80 and rail 24. The design of ribs 190 and 192 also provides more pressure contact between the insert and rails than would otherwise be the case were a flat smooth surface substituted therefor.

In assembly of the unit, lower brush assembly brackets 156 and 158 are secured to channel bracket 76 by fasteners 160. Insert 80 is then positioned within channel bracket 76 with lips 156*a* and 158*a* of brackets 156 and 158, respectively, engaged against steps 182 at the lower end of insert 80. With insert 80 in place within channel bracket 76, upper brush assembly brackets 90 and 92 and cleaning reservoir bracket 120 are attached to channel bracket 76 by bolts 94 and 96. Lips 90*a* and 92*a* of brackets 90 and 92, respectively, mate with steps 180 at the upper end of insert 80 to retain the insert within channel bracket 76. With the attachment of brush assembly brackets 90, 92, 156 and 158 to channel bracket 76 and the attachment of reservoir bracket 120 to channel bracket 76, each of the brush assemblies and reservoir 108 is pre-positioned relative to rail 24. The position of the individual brush assemblies relative to the rail may be altered by adjusting brush assemblies 86, 88, 140 and 142 relative to their respective brackets. In this way, the brushes may be set in proper contact with rail 24.

This assembly is then attached to bracket 70 by the insertion of trunnion 78 into sleeve 72 of bracket 70. Bracket 70 is then attached to the upper channel member 36 attached on car elevator 30.

FIGS. 2–5 illustrate only a single guide assembly 50. It will be understood that two such assemblies, identical one to the other, are used in the present invention. The units are both attached to the upper crosshead channel member 36, one adjacent to and in contact with rail 24 and the other adjacent to and in contact with rail 26.

In operation of the present invention, cable 60 is drawn in or let out to move elevator car 30 through hoistway 22. Car 30 is guided along rails 24 and 26 by guide assemblies 50. As the elevator is raised and lowered, insert 80 of guide assemblies 50 continuously contacts rail 24. As a result, the bronze or brass embedded within the elastomeric foundation of the insert is applied directly against surfaces 24*a* of rail 24. This contact produces a scouring action between insert 80 and rail 24 to remove rust and corrosion from the surface. As mentioned earlier, this rust and corrosion is channeled by troughs 194 and 196 of insert 80 away from the contact surface between the insert and guide rails.

Periodically, or on a continuous basis as desired, cleaning fluid is discharged from reservoir 108 through lines 104, 106, 148 and 150 to brush assemblies 86, 88, 140 and 142, respectively. Fluid is applied to brushes 100, 102, 144 and 146 which are in contact with rail surfaces 24*a* of rail 24. In many elevator systems, rails 24 are supplied with a plastic coating thereon. It has heretofore been the practice to manually remove such coating as it has been undesirable to remove the coating from the entire rail because of the protection provided by the coating. In the present invention, the cleaning solution in reservoir 108, in cooperation with the brushes used to apply the solution to rail 24, operates to remove the coating from the rail as the elevator is operated. Additionally, contact of insert 80 against rail 24 acts to remove the plastic coating from the surface of the rail.

In another embodiment of the invention illustrated in FIGS. 6–10, a guide assembly 250 is attached to upper crosshead channel member 36 of elevator car 30 adjacent guide rail 24. Similarly, an identical guide assembly 250 is attached to the opposite end of upper crosshead channel member 36 adjacent guide rail 26. Cleaning assemblies 254 are mounted adjacent to each guide assembly 250 and engage rails 24 and 26. Guide assemblies 250 engage the guide rails 24 and 26, as will be hereinafter discussed in greater detail, to guide and stabilize the elevator car as it moves along the guide rails.

Figure 7:
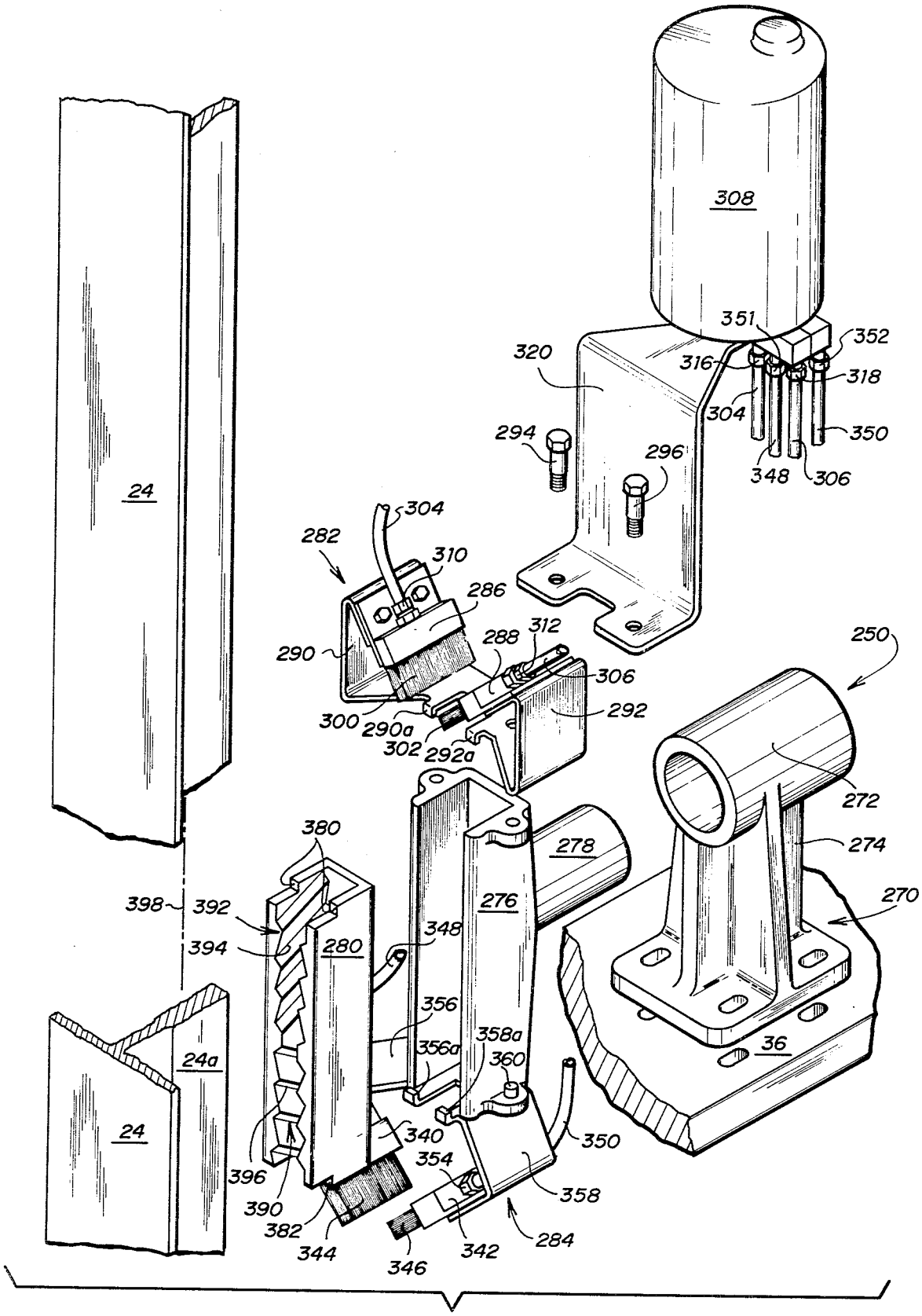
FIG. 7 is an enlarged exploded perspective view of the elevator guide system of the embodiment of FIG. 6.

One of the guide assemblies 250 and cleaning assemblies 254 is shown in greater detail in FIGS. 7–10. Referring to FIG. 7, guide assembly 250 includes a bracket 270 having a sleeve portion 272 supported from a base 274 which is attached to upper crosshead channel member 36. A channel bracket 276 is formed with a trunnion 278 which is received in sleeve 272 of bracket 270. A channel insert 280 formed in a U-shaped configuration is received within the mouth of channel bracket 276.

Cleaning assembly 254 includes an upper unit 282 and a lower unit 284. Upper unit 282 includes a pair of brush assemblies 286 and 288 supported from channel bracket 276 by brackets 290 and 292, respectively. Brackets 290 and 292 are attached to channel bracket 276 by any suitable means such as bolts 294 and 296, respectively. When attached to the upper end of channel bracket 276, brackets 290 and 292 partially close the upper end of bracket 276. Brackets 290 and 292 are also formed with turned down lips 290*a* and 292*a*, respectively.

Brush assemblies 286 and 288 include brushes 300 and 302, respectively, which are fed liquid through lines 304 and 306, respectively, from a fluid reservoir 308. Fluid reservoir 308 is supported from channel bracket 276 and above brush brackets 290 and 292 by bracket 320. Bolts 294 and 296 are used for the attachment of bracket 320 to channel bracket 276 as is illustrated in FIG. 7. The connection of lines 304 and 306 to brush assemblies 286 and 288 are by way of appropriate couplings 310 and 312. Similarly, lines 304 and 306 are attached to reservoir 308 by couplings 316 and 318, respectively.

Figure 9:
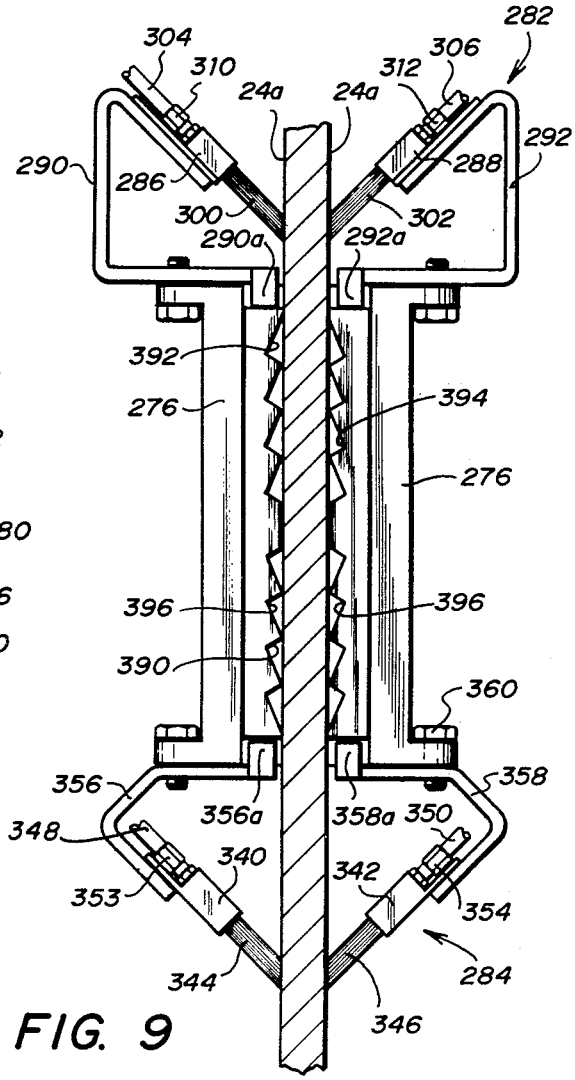
FIG. 9 is a section view taken along line 9—9 of FIG. 8.

Lower cleaning assembly 284 is similar in construction to upper cleaning assembly 282. Specifically, lower cleaning assembly 284 includes brush assemblies 340 and 342 which support brushes 344 and 346 therefrom. Brushes 344 and 346 are fed by way of lines 348 and 350, respectively. Lines 348 and 350 are attached at one end to reservoir 308 by couplings 351 and 352, respectively. The opposite ends of lines 348 and 350 are connected to assemblies 340 and 342 by appropriate couplings 353 and 354 (FIG. 9). Brush assemblies 340 and 342 are supported from channel bracket 276 by brackets 356 and 358. Brackets 356 and 358 are attached to channel bracket 276 by suitable means such as fasteners 360 and when attached to channel bracket 276 partially close the lower end of channel bracket 276. Brackets 356 and 358 are formed with upturned lips 356*a* and 358*a*, respectively.

Insert 280 is formed as a U-shaped channel with its outer dimensions sized so that it is receivable within channel bracket 276. The upper and lower ends of insert 280 are formed with steps 380 and 382, respectively.

When assembled, steps 380 and 382 are engaged by lips 290*a*, 292*a* and 356*a*, 358*a*, respectively, which retain insert 280 in a seated position within channel bracket 276.

Figure 10:
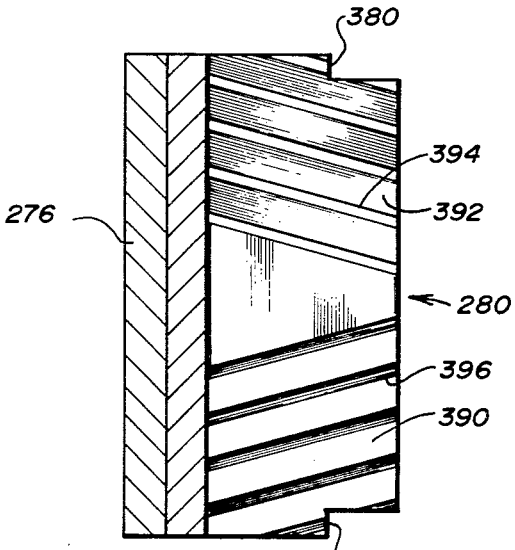
FIG. 10 is a section view taken along line 10—10 of FIG. 8.

Referring to FIGS. 7, 9 and 10, the inner side walls of insert 280 are formed with a plurality of ribs 390 and 392 with troughs 394 and 396 formed therebetween. As is best seen in FIG. 10, ribs 392 are inclined upwardly from the open mouth of insert 280 while ribs 390 are inclined downwardly from the mouth of insert 280. Both ribs 390 and 392 are inclined relative to the longitudinal axis identified by numeral 398 of rail 24 and toward the side surfaces 24*a* thereof (FIG. 7).

In this embodiment of the invention, insert 280 is constructed from an elastomeric material having lead embedded therein. The elastomeric material forms a matrix with the lead being embedded throughout the insert. Insert 280 is designed to be in contact with surfaces 24*a* of rail 24. In one form of the embodiment, insert 280 is in interference contact with surfaces 24*a* of rail 24 while in another embodiment, a slight clearance is provided between the ribs 390 and 392 on the inner side surface of insert 280 and surfaces 24*a* of rail 24. In this embodiment, clearance is provided to prevent binding between insert 280 and rail 24. However, periodic contact is assured between the insert and rail 24 as the elevator car moves relative to the rail.

Use of an insert formed from an elastomeric material with lead embedded therein has been found to be extremely successful in filling pits and other irregularities in the rails caused by corrosion or wear. The elastomeric material provides resilience at the point of contact between the elevator rail and the guide assembly while assuring the continuous contact of lead against the rail surfaces. As the guide assembly insert is brought into contact with the elevator rail, lead embedded in the insert is transferred to the rail to fill pits and irregular areas therein. Lead is also deposited between the ends of adjacent rails to provide a smooth transition from one rail section to the next. By this arrangement, the present invention provides for continuous, as opposed to only periodic, repair of the rails as a result of the continuous contact between insert 280 and rail 24.

The inclined ribs 390 and 392 and the intermediate troughs therebetween act to wipe away lead not deposited in pits or cracks in the rails as well as to direct lead transferred to the rail into these areas. The design of ribs 390 and 392 also provides more contact pressure between the insert and rails than would otherwise be the case were a flat smooth surface substituted therefor. This additional pressure assists in embedding lead into the areas in need of filling.

In assembly of the unit, lower brush assembly brackets 356 and 358 are secured to channel bracket 276 by fasteners 360. Insert 280 is then positioned within channel bracket 276 with lips 356*a* and 358*a* of brackets 356 and 358, respectively, engaged against steps 382 at the lower end of insert 280. With insert 280 in place within channel bracket 276, upper brush assembly brackets 290 and 292 and cleaning reservoir bracket 320 are attached to channel bracket 276 by bolts 294 and 296. Lips 290*a* and 292*a* of brackets 290 and 292, respectively, mate with steps 380 at the upper end of insert 280 to retain the insert within channel bracket 276. With the attachment of brush assembly brackets 290, 292, 356 and 358 to channel bracket 276 and the attachment of reservoir bracket 320 to channel bracket 276, each of the brush assemblies and reservoir 308 is pre-positioned relative to rail 24. The position of the individual brush assemblies relative to the rail may be altered by adjusting brush assemblies 286, 288, 340 and 342 relative to their respective brackets. In this way, the brushes may be set in proper contact with rail 24.

This assembly is then attached to bracket 270 by the insertion of trunnion 278 into sleeve 272 of bracket 270. Bracket 270 is then attached to the upper channel member 36 attached on car elevator 30.

FIGS. 7–10 illustrate only a single guide assembly 250. It will be understood that two assemblies, identical one to the other, are used in the present invention. Both units are attached to the upper crosshead channel member 36, one adjacent to and contacting rail 24 and a second adjacent to and contacting rail 26.

In operation of this embodiment of the invention, cable 60 is drawn in or let out to move elevator car 30 through hoistway 22. Car 30 is guided along rails 24 and 26 by guide assemblies 250. As the elevator is raised and lowered, insert 280 of guide assemblies 250 continuously contacts rail 24. As a result, the lead embedded within the elastomeric foundation of the insert is applied directly against surfaces 24*a* of rail 24. This contact causes a transfer of lead to the rails to fill pits, irregular areas and gaps between adjacent rails.

Periodically, or on a continuous basis as desired, cleaning fluid is discharged from reservoir 308 through lines 304, 306, 348 and 350 to brush assemblies 286, 288, 340 and 342, respectively. Fluid is applied to brushes 300, 302, 344 and 346 which are in contact with rail surfaces 24*a* of rail 24. The cleaning solution in reservoir 308, in cooperation with the brushes used to apply the solution to rail 24, operates to remove any dirt or protective coatings which may be on new rails.

Thus, the present invention provides an elevator system which continuously cleans rust and corrosion from the elevator rails by the use of an elastomeric insert having bronze or brass embedded therein which is brought into contact with the elevator rails. The elastomeric insert provides resilience at the point of contact between the insert and the elevator rail while assuring continuous contact between the bronze or brass embedded therein with the rail surfaces. The insert is designed to provide increased pressure contact with the rail surfaces while providing for the discharge of rust and corrosion removed by the system.

The present invention also provides for the application of a liquid cleaning solution applied by brushes to assist in cleaning of the elevator rails.

In another embodiment of the invention, the elastomeric insert used at the point of contact between the elevator car and the elevator rail has particles of lead embedded therein. The elastomeric material forming the insert provides a resilient contact between the rail and the elevator car while assuring the continuous application of lead particles in the insert with the elevator rail. As a result of this contact, lead is transferred from the elastomeric insert to the rails to fill pits and other irregularities which exist in the elevator rail.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the appended claims.

What is claimed is:

1. In an elevator system of the type including an elevator car guided for movement along a guide rail by a guide assembly including a channel-shaped bracket mounted on the car adjacent to the rail and a channel-shaped resilient insert secured within the bracket in interference contact with the rail, the improvement comprising:

said insert being formed of elastomeric material embedded with particles of metal selected from the group consisting of brass and bronze materials;

said insert having a working surface with spaced apart side portions connected by an end portion; and at least one of the side working surface portions of said insert including a plurality of ribs and intermediate troughs of generally V-shaped cross section inclined relative to the longitudinal axis and toward the side surface of the guide rail to channel away loose material cleaned from the rail by the insert during operation of the car.

2. The elevator system of claim 1, wherein the ribs and troughs in said insert are arranged in two groups inclined in opposite directions relative to the longitudinal axis of said guide rail.

3. The elevator system of claim 1, wherein each side working surface portion of said insert includes a plurality of ribs and intermediate troughs of generally V-shaped cross section inclined relative to the longitudinal axis of the guide rail to channel away loose material cleaned from the rail by the insert during operation of the car.

4. The elevator system of claim 1, including:

a brush mounted on the guide assembly, said brush having an end positioned to engage the guide rail adjacent to the guide assembly; and means for directing a cleaning fluid to said brush for application onto the guide rail.

5. The elevator system of claim 1, including:

a pair of brushes mounted at opposite ends of the guide assembly, each of said brushes having an end positioned to engage the guide rail adjacent to the guide assembly; and means for directing a cleaning fluid to each of said brushes for application onto the guide rail.

6. An elevator rail cleaning system for use with an elevator car supported for movement along a guide rail, comprising:

a rigid guide bracket mounted on the car adjacent to the rail;

a resilient insert secured to said guide bracket in interference contact with the rail;

said guide bracket and resilient insert are each of generally channel-shaped cross section, and the surface of said insert in contact with said rail includes a plurality of ribs and intermediate troughs of generally V-shaped cross section inclined relative to the longitudinal axis and toward the side surface of said guide rail to channel away loose material cleaned from the rail by said insert;

said insert being formed of elastomeric material embedded with particles of metal selected from the group consisting of brass and bronze materials to remove rust and corrosion from the rail during operation of the elevator car;

a pair of brushes mounted at opposite ends of said guide bracket and positioned to engage the guide rail adjacent thereto; and means for directing a cleaning fluid to each of said brushes for application onto the guide rail.

7. The elevator rail cleaning system according to claim 6, wherein the ribs and troughs in said insert are arranged in two groups inclined in opposite directions relative to the longitudinal axis of said guide rail.

8. A method of cleaning rust and corrosion from a guide rail in an elevator system with an elevator car guided for movement along the guide rail, comprising the steps of:

providing a rigid channel-shaped bracket;

attaching the bracket to the elevator car adjacent to the guide rail;

providing a resilient channel-shaped insert of elastomeric material embedded with particles of metal selected from the group consisting of brass and bronze materials;

forming into the insert a plurality of transverse ribs and troughs of generally V-shaped cross section inclined relative to the longitudinal axis of the insert and toward the side surface of said guide rail when the ribs are in contact with the guide rail;

securing the insert to the bracket with the ribs of the insert in interference contact with the guide rail;

providing a brush suitable for liquid conveyance;

mounting the brush on the bracket with the end of the brush in contact with the guide rail adjacent to the insert;

conveying a cleaning fluid to the brush for application onto the guide rail; and operating the elevator car to remove rust and corrosion from the guide rail with the insert.

9. In an elevator system of the type including an elevator car guided for movement along a guide rail by a guide assembly including a channel-shaped bracket mounted to the car adjacent to the rail and a channel-shaped resilient insert secured within the bracket in interference contact with the rail, the improvement comprising:

said insert being formed of elastomeric material embedded with particles of lead;

said insert having a working surface with spaced apart side portions connected by an end portion; and at least one of the side working surface portions of said insert including a plurality of ribs and intermediate troughs of generally V-shaped cross section inclined relative to the longitudinal axis and toward the side surface of the guide rail to channel away loose lead particles and other material cleaned from the rail by the insert during operation of the car.

10. The elevator system of claim 9, wherein the ribs and troughs in said insert are arranged in two groups inclined in opposite directions relative to the longitudinal axis of the guide rail.

11. The elevator system of claim 9, wherein each side working surface portion of the insert includes a plurality of ribs and troughs of generally V-shaped cross section inclined relative to the longitudinal axis of the guide rail to channel away loose lead particles and other particles cleaned from the rail by the insert during operation of the car.

12. The elevator system of claim 9, including:

a brush mounted on the guide assembly, said brush having an end positioned to engage the guide rail adjacent to the guide assembly; and means for directing a cleaning fluid to said brush for application onto the guide rail.

13. The elevator system of claim 9, including:

a pair of brushes mounted at opposite ends of the guide assembly, each of said brushes having an end positioned to engage the guide rail adjacent to the guide assembly; and means for directing a cleaning fluid to each of said brushes for application onto the guide rail.

14. An elevator rail maintenance system for use with an elevator car supported for movement along a guide rail, comprising:

a rigid guide bracket mounted on the car adjacent to the rail;

a resilient insert secured to said guide bracket in interference contact with the rail;

said guide bracket and insert are each of generally channel-shaped cross section, and the surface of said insert in contact with said rail includes a plurality of ribs and intermediate troughs of generally V-shaped cross section inclined relative to the longitudinal axis of the insert and toward the side surface of said guide rail when in contact therewith to channel away loose lead particles and other material cleaned from the rail by the insert;

said insert being formed of elastomeric material embedded with particles of metal such that pits and irregularities in the guide rail are filled in with lead during operation of the elevator car;

a pair of brushes mounted at opposite ends of said guide bracket and positioned to engage the guide rail adjacent thereto; and means for directing a cleaning fluid to each of said brushes for application onto the guide rail.

15. The elevator rail maintenance system according to claim 14, wherein the ribs and troughs in said insert are arranged in two groups inclined in opposite directions relative to the longitudinal axis of said guide rail.

16. A method of filling pits and irregularities in a guide rail of an elevator system with an elevator car guided for movement along the guide rail, comprising the steps of:

providing a rigid channel-shaped bracket;

attaching the bracket to the elevator car adjacent to the guide rail;

providing a resilient channel-shaped insert of elastomeric material embedded with particles of lead;

forming into the insert a plurality of transverse ribs and intermediate troughs of generally V-shaped cross section inclined relative to the longitudinal axis of the insert and toward the side surface of said guide rail when the ribs are in contact with the guide rail to channel loose material away from the guide rail;

securing the insert to the bracket with the ribs of the insert in interference contact with the guide rail;

providing a brush suitable for liquid conveyance;

mounting the brush on the bracket with the end of the brush in contact with the guide rail adjacent to the insert;

conveying a cleaning fluid to the brush for application onto the guide rail; and operating the elevator car to transfer lead from the insert into pits and irregularities on the guide rail.

* * * * *